US005526245A

United States Patent [19]

Davis et al.

[11] Patent Number: 5,526,245

[45] Date of Patent: Jun. 11, 1996

[54] LIGHTING SYSTEM FOR MEDICAL PROCEDURES

[75] Inventors: Donald W. Davis, Grosse. Pointe Woods; Jana K. Brownell; Stephen C. Brownell, both of Grosse Pointe Farms, all of Mich.

[73] Assignee: The Kirlin Company, Detroit, Mich.

[21] Appl. No.: 155,481

[22] Filed: Nov. 22, 1993

[51] Int. Cl.[6] ..... F21V 21/00; F21M 1/00

[52] U.S. Cl. ..... 362/233; 362/272; 362/386; 362/804; 362/286; 359/147

[58] Field of Search ..... 362/386, 233, 362/419, 804, 418, 364, 272, 285, 286, 802, 147, 801, 394; 248/206.5; 211/87, DIG. 1, 13; 359/147, 142, 145, 572; 340/825.17, 825.72, 825.37

[56] References Cited

U.S. PATENT DOCUMENTS

| | | | |
|---|---|---|---|
| 3,702,928 | 11/1972 | Alger | 362/233 X |
| 4,078,720 | 3/1978 | Nurnberg | 236/46 R |
| 4,200,862 | 4/1980 | Campbell et al. | 340/825.07 X |
| 4,288,844 | 9/1981 | Fishet et al. | 362/804 X |
| 4,365,720 | 12/1982 | Kaneshiro | 211/87 |
| 4,578,575 | 3/1986 | Roos | 250/203 |
| 4,639,838 | 1/1987 | Kato et al. | 362/33 |
| 4,709,412 | 11/1987 | Seymour et al. | 455/128 |
| 4,712,167 | 12/1987 | Gordin et al. | 362/233 |
| 4,728,949 | 3/1988 | Platto et al. | 340/825.37 |
| 4,817,203 | 3/1989 | Tsurumoto et al. | 455/603 |
| 4,826,059 | 5/1989 | Bosch et al. | 211/DIG. 1 |
| 4,890,207 | 12/1989 | Jones | 362/233 |
| 5,010,459 | 4/1991 | Taylor et al. | 362/233 X |
| 5,031,082 | 7/1991 | Bierend | 362/233 X |
| 5,038,261 | 8/1991 | Kloos | 362/286 |
| 5,060,124 | 10/1991 | Crispin et al. | 362/804 X |
| 5,068,767 | 11/1991 | Koyama | 362/33 |
| 5,072,216 | 12/1991 | Grange | 362/233 X |
| 5,093,769 | 3/1992 | Luntsford | 362/804 X |
| 5,189,412 | 2/1993 | Mehta et al. | 340/825 |
| 5,294,915 | 3/1994 | Owen | 340/539 |

FOREIGN PATENT DOCUMENTS

| | | | |
|---|---|---|---|
| 2449994 | 9/1980 | France . | |
| 0014536 | 1/1985 | Japan | 359/147 |

OTHER PUBLICATIONS

Sharp VC–M860U Brochure, Sep. 1990 (pp. 1–21).
Skytron Sales Brochure, AR 3002–Jun. 1990.
Lightolier Sales Brochure, Jan. 1992.

*Primary Examiner* Denise L. Gromada
*Assistant Examiner* Thomas M. Sember
*Attorney, Agent, or Firm* Young & Basile

[57] ABSTRACT

A room lighting system specially suited for medical procedures. The system includes first and second light assemblies adapted to be mounted in the ceiling of the procedure room and each including a lamp movable between a plurality of angular positions. The lamps are controlled by a wall control unit mounted in a wall of the procedure room or by a remote control unit including an infrared transmitter communicating with an infrared receiver mounted in the wall control unit. The light assemblies can be controlled individually as to both intensity and angular position either from the wall control unit or from the remote control unit. Each light assembly includes a transformer which receives line power and steps the line power down to a 24 volt circuit to control the intensity of the lamp and a 12 volt circuit which includes all of the controls for the light assembly.

5 Claims, 6 Drawing Sheets

28
30
134
48
46
10
136
132
138
130
32
140
36
72
12
120
78
15
70
121
114
118
112
108
110
122
116
106
104
119
76
76a
74

LIGHTING SYSTEM FOR MEDICAL PROCEDURES

BACKGROUND OF THE INVENTION

Medical procedures require very special lighting. Specifically, medical procedures require a light that is bright, essentially shadow free, and that can be easily and conveniently adjusted to vary both the intensity and the directional aspects of the light.

Whereas various prior art lighting devices have been proposed for medical procedures, the prior art devices suffer one or more disadvantages. Specifically, the prior art devices tend to clutter the room in which the medical procedure is being performed; they are difficult to adjust with respect to intensity and/or position; they require movement of medical personnel to a dedicated location to accomplish the required adjustment; they are bulky and heavy to a point where they are difficult to mount in the drop ceilings of modern medical rooms; they are difficult to install and/or to maintain; they incorporate high voltages that can be dangerous both to medical personnel and to the patient; they involve mechanisms that allow the lights to drift inadvertently during the medical procedures; and they lack versatility with respect to individual or joint use of the plurality of lights of the system.

SUMMARY OF THE INVENTION

This invention is directed to the provision of an improved lighting system for medical procedures.

More specifically, this invention is directed to the provision of an improved lighting system for medical procedures which provides excellent shadow free lighting for the procedure, is readily and conveniently adjustable both with respect to light intensity and light direction, and which provides excellent versatility with respect to the use of the system for various medical procedure lighting requirements.

The invention room lighting system includes a first light assembly adapted to be mounted in the ceiling of the medical procedure room and including a lamp movable between a plurality of angular positions; a second light assembly adapted to be mounted in the room ceiling in spaced but predetermined relation to the first light and including a lamp movable between a plurality of angular positions; and control means including a single control unit including control elements operative in response to selective actuation of the elements to selectively and individually adjust the angular position of each lamp of each light assembly. This arrangement allows the angular position of each lamp to be individually adjusted from a single control unit location.

According to a further feature of the invention, the single control unit comprises a wall control unit adapted to be positioned in a wall of the room; the wall control unit is hard wired to the light assembly; the system further includes a remote control unit having control elements corresponding to the control elements of the wall control unit and including an infrared transmitter; and the wall control unit includes an infrared receiver operative to receive the transmissions of the infrared transmitter. This arrangement allows the light assemblies to be controlled jointly or individually from either the wall control unit or from the remote control unit.

According to a further feature of the invention, the wall control unit defines a storage surface sized to store the remote control unit. This arrangement provides a convenient means of accounting for the remote control unit and ensuring that it is not separated from the remainder of the lighting assembly. In the disclosed embodiment of the invention, the remote control unit is releasably stored on the wall control unit by magnetic means.

According to a further feature of the invention, the remote control unit includes means operative to emit a warning signal if the remote control unit is separated from the wall control unit for a predetermined length of time or is not activated for a predetermined length of time. This arrangement further ensures that the remote control unit will not become separated from the associated lighting assembly.

The invention further provides a room lighting system for medical procedures comprising a light assembly adapted to be mounted in the ceiling of the room and including a lamp movable between a plurality of angular positions; and control means for the light assembly including an infrared remote control element operative when actuated to generate infrared transmission, means receiving infrared transmissions from the remote control unit, and means operative in response to such receipt to selectively adjust the angular position of the lamp. This arrangement provides a convenient and effective means for adjusting the angular position of the lamp of the light assembly from any position within the room.

According to a further feature of this aspect of the invention, the lighting system further includes a wall control unit adapted to be mounted in a wall of the room and the means for receiving the infrared signals comprises an infrared receiver mounted in the wall control unit.

According to a further aspect of the invention, a room lighting system is provided for medical procedures comprising a light assembly including a housing adapted to be mounted in the ceiling of the room and a lamp mounted within the housing for movement between a plurality of angular positions; a wall plate unit adapted to be mounted in a wall of the room and including control means for controlling the light assembly; means establishing a first electrical circuit, including the lamp, of a first voltage; and means establishing a second electrical circuit, including the wall plate unit, of a second voltage lower than the first voltage. For example the first voltage for the circuit including the lamp may comprise 24 volts and the second voltage for the circuit including the wall plate unit may comprise 12 volts. This arrangement ensures that all of the components of the system which either the patient or the medical personnel may contact, either directly or indirectly, are at a voltage sufficiently low to avoid harm to either the patient or the medical personnel.

In the disclosed embodiment of the invention, the means establishing the first and second circuits comprises a transformer receiving line power and operative to step down the line power to the first voltage for use by the first circuit and further operative to step down the line power to the second voltage for use by the second circuit. For convenience in packaging, the transformer may be mounted on the housing of the light assembly.

The invention further provides a unique ceiling fixture system. The invention ceiling fixture system includes a fixture adapted to be mounted in the ceiling of a room and having at least one operational aspect; a wall control unit adapted to be mounted in a wall of the room and including an infrared receiver and control elements operative to generate control signals; an infrared remote control unit including control elements and an infrared transmitter operative in response to actuation of the control elements to generate infrared signals for receipt by the infrared receiver; and control means operative in response to receipt of the infrared signals from the remote control unit or control signals from the control elements of the wall control unit to control the operational aspect of the ceiling fixture.

In the disclosed embodiment of the invention, the ceiling fixture comprises a light assembly having a lamp movable between a plurality of angular positions and the control means is operative to control the angular position of the lamp.

DETAILED DESCRIPTION OF THE PREFERRED EMBODIMENTS

Figure 1:
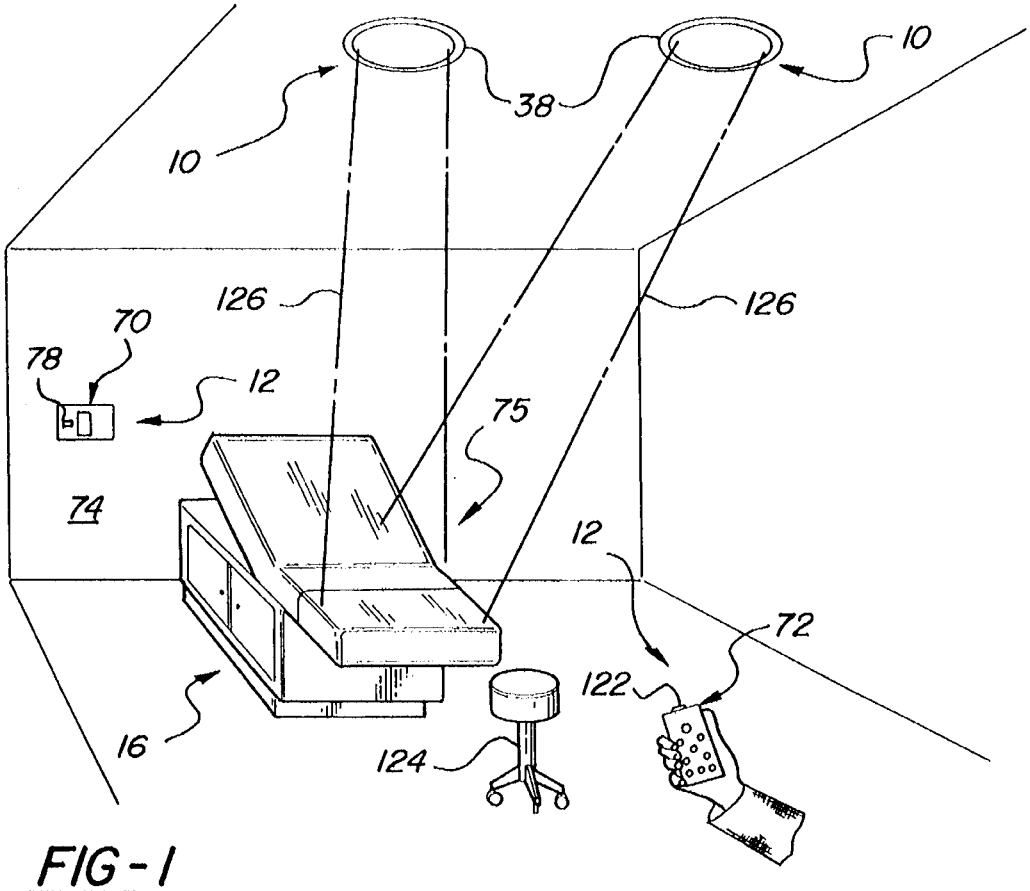
FIG. 1 is a perspective somewhat diagrammatic view of a medical procedure room in which the lighting system of the invention is installed.

The invention lighting system, broadly considered, includes a pair of luminaires or lighting assemblies 10 and a control assembly 12.

Assemblies 10 are intended to be mounted in the tile drop ceiling 14 of a medical procedure room 16 so as to position the assembly 10 between the drop ceiling 14 and the permanent ceiling 18 of the room.

Each assembly 10 includes a downwardly opening housing 20 of generally hollow rectilinear configuration, a plurality of brackets 22, a plurality of channel bars 24, a trim assembly 26, an outlet box 28, a transformer 30, a control box 32, a lamp assembly 34, and a cable 36. Housing 20 is positioned above drop ceiling 14 by brackets 22 which are suitably secured to side walls **20*a* of the housing 20 and include notches 22*a* which pass channel bars 24 which are in turn supported on the upper edges of wire suspended divider bars 38 supporting the tiles 40 of the drop ceiling. Each notch 22*a* includes a plurality of vertically spaced horizontal notch portions 22*b* which allow vertically adjustable positioning of the bars 24** in the notches.

Trim assembly 26 includes a white regressed self-flanged flare member 38 positioned in a suitable opening in the ceiling tiles, a filter 40 positioned within the flare, and a tempered clear glass 42 positioned below the filter and within the flare.

Outlet box 28 is suitably secured to an end wall **20*b* of housing 20 and provides connection for a cable 44** providing 120 volts of AC line power to the lighting assembly.

Transformer 30 is suitably secured to a side wall **20*a*** of the housing and may comprise for example a 120 volt to 24 volt step down class H (encapsulated) transformer.

Control box 32 is suitably secured to end wall **20*c* of the housing and includes a printed circuit board 37 including an RFI filter built into the circuit board. Cable 36 is connected at one end to control box 32 and is adapted to be connected at its other end to control assembly 12**.

Lamp assembly 34 comprises a gimble cage assembly 44, a lamp 46, a reflector 48, a first electric motor 50, and a second electric motor 52.

Gimble cage assembly 44 is intended to mount lamp 46 within housing 20 for angular movement about two axes of rotation. Gimble assembly 44 includes a U-shaped downwardly opening bracket 54 secured to the upper wall 20d of housing 20; a U-shaped downwardly opening bracket 56 positioned within bracket 54 and pivotally mounted with respect thereto about an axis 58; a U-shaped downwardly opening bracket 60 secured to bracket 56; and a U-shaped downwardly opening bracket 62 positioned within bracket 60 and pivotally mounted thereto about an axis 64. Motor 50 is secured to bracket 60 and motor 52 is secured to bracket 54. Motor 50 includes a link 66 secured to the output shaft of the motor and including a guide roller 68 mounted in a slot **62*a* in bracket 62 so that actuation of motor 50 results in angular movement of arm 66 with resultant vertical displacement of roller 68 in slot 62 and resultant angular movement of bracket 62 about axis 64. Similarly, motor 52 includes an arm secured to the output shaft of the motor and including a roller guided in a slot in bracket 56 so that actuation of motor 52 results in tilting movement of bracket 56 about axis 58. It will be seen that selective actuation of motors 50 and 52 enables the lamp assembly to be tilted or pivoted relative to the housing 20** about two separate axes with the extent of pivotal movement in each case determined by the geometry of the elements connecting the output of the motor and the respective bracket.

Lamp 46 may comprise for example a 150 watt, 24 volt 3,000° K. by-pin tungsten halogen lamp. Lamp 46 is positioned within reflector 48 which may comprise a polished specular aluminum member.

Control assembly 12 includes a wall control unit 70 and a remote control unit 71.

Wall control unit 70 is intended to be flush mounted in a side wall 74 of room 16, preferably proximate the head of bed 75, and includes a face plate 72, an outlet box 74, a circuit board 76 positioned within the outlet box rearwardly of the face plate, and an infrared receiver 78 positioned in the face plate.

Figure 9:
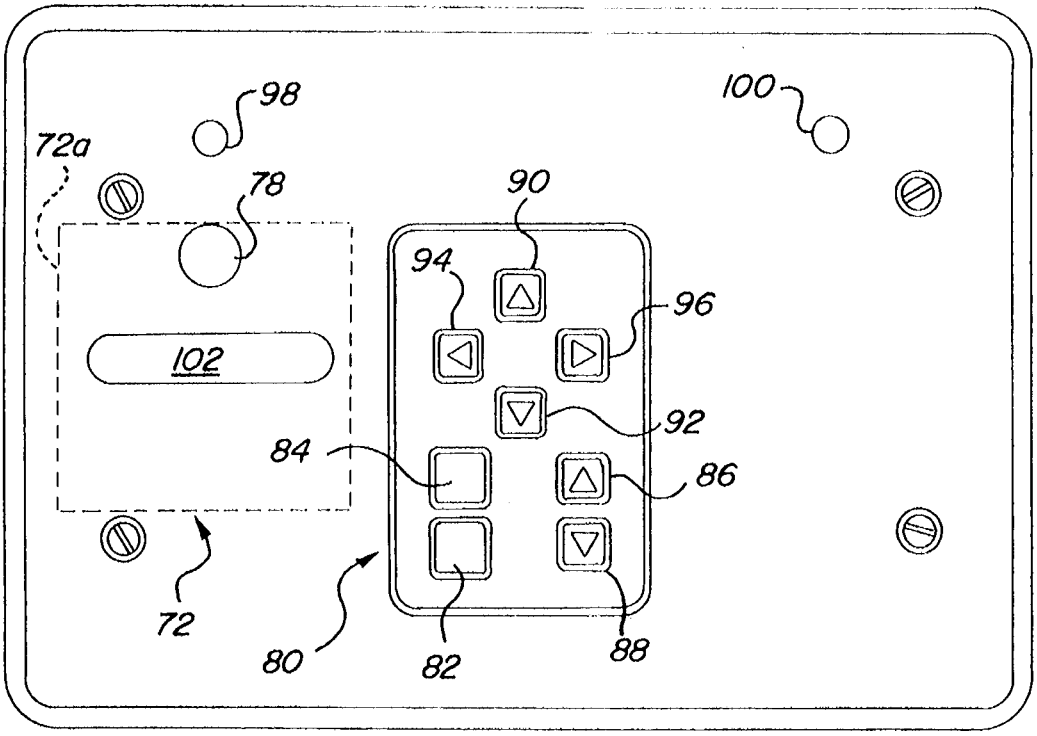
FIG. 9 is a view of a wall plate unit utilized in the invention lighting system.
Figure 10:
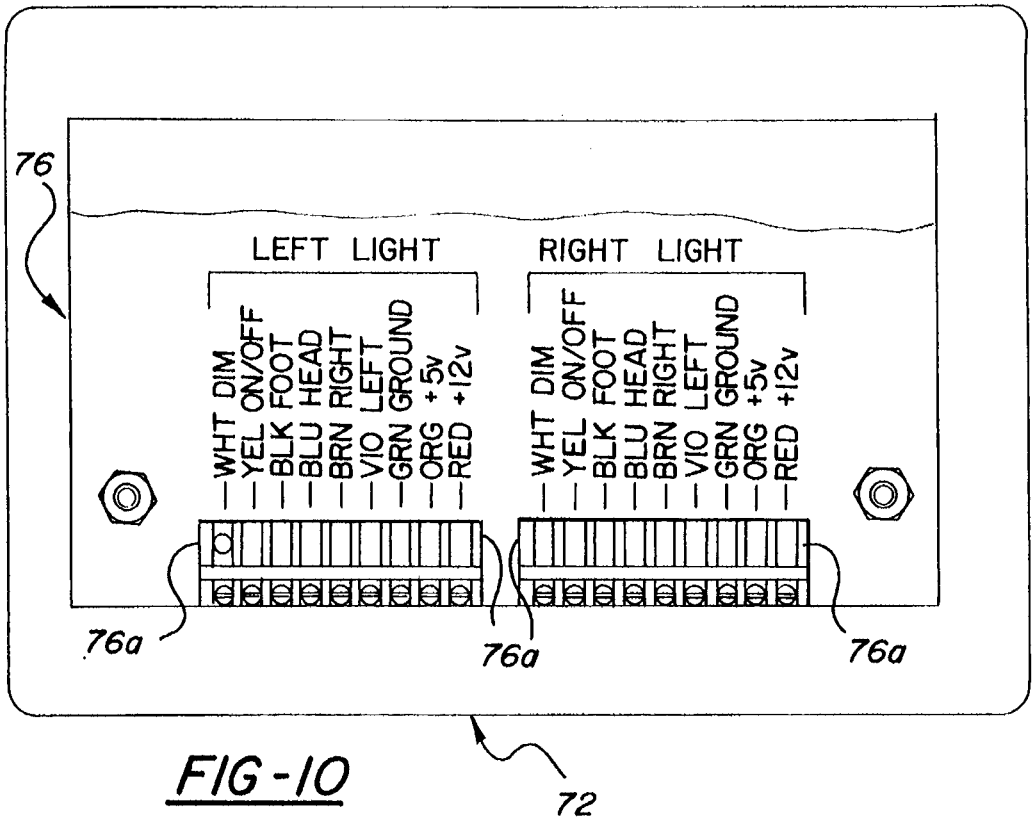
FIG. 10 is a rear view of the wall plate unit of FIG. 9.

As seen in FIG. 9, face plate 72 includes a cluster 80 of tactile-membrane switches for controlling the light assemblies 10. Specifically, cluster 80 includes an on/off switch 82, a select light switch 84, a bright switch 86, a dim switch 88, a head switch 90, a foot switch 92, and adjust position switches 94 and 96. Face plate 72 further includes a left light LED 98 and a right light LED 100. Face plate 72 further defines a flat storage surface area **72*a* for storage of remote control unit 71 and including a magnet 102 adapted for coaction with a magnet on the remote control unit to maintain the remote control unit in a stored position against the face plate within storage area 72*a*. Face plate 72 further includes directions for use of the control cluster 80**.

The rear face of the circuit board 76 includes a plurality of color coded terminal blocks and, specifically, includes nine terminal blocks 76*a* for each light assembly 10 for a total of 18 terminal blocks. The terminal blocks for each light assembly include a white dimmer block, a yellow on/off block, a black foot block, a blue head block, a brown right block, a violet left block, a green ground block, an orange 5 volt block, and a red 12 volt block.

It will be understood that control cable 36 of each light assembly 10 includes nine leads which are color coded to correspond respectively to the color coding of the corresponding nine terminal blocks on the rear face of the circuit board of the wall control unit so that the cables 36 may be passed through the outlet box and the nine leads of each cable may be selectively inserted in the correspondingly color coded terminal blocks so that the nine leads from the cable 36 of one light assembly 10 are inserted into the nine terminal blocks labeled left light and the nine leads from the cable 36 associated with the other light assembly 10 are connected to the nine blocks labeled right light.

Figures 4, 11, 12, 15:
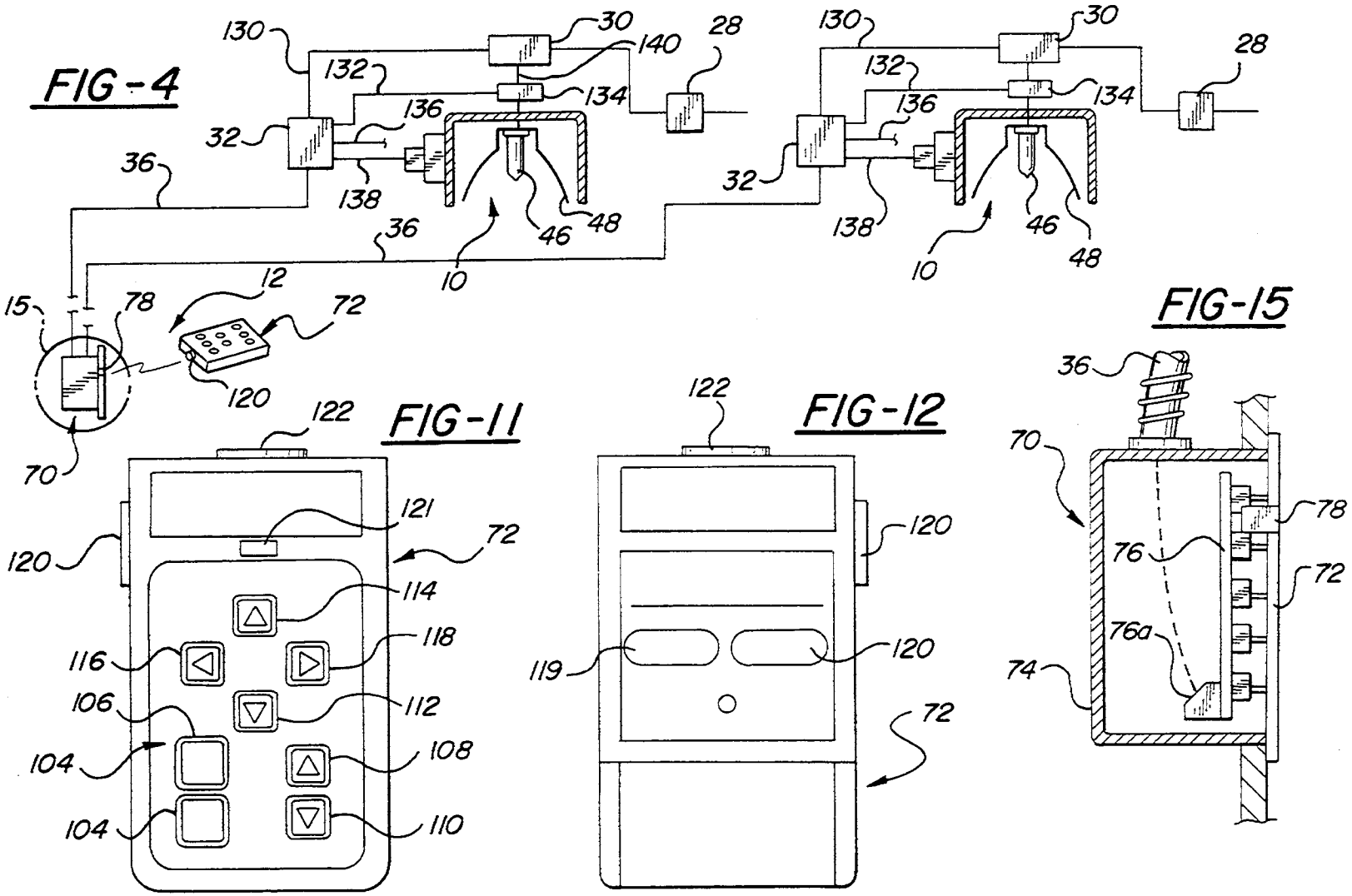
FIG. 4 is a diagrammatic view of the invention lighting system.
FIGS. 11 and 12 are front and rear views respectively of a remote control unit utilized in the invention lighting system.
FIG. 15 is a detail view taken within the circle 15 of FIG. 4.
Figure 5:
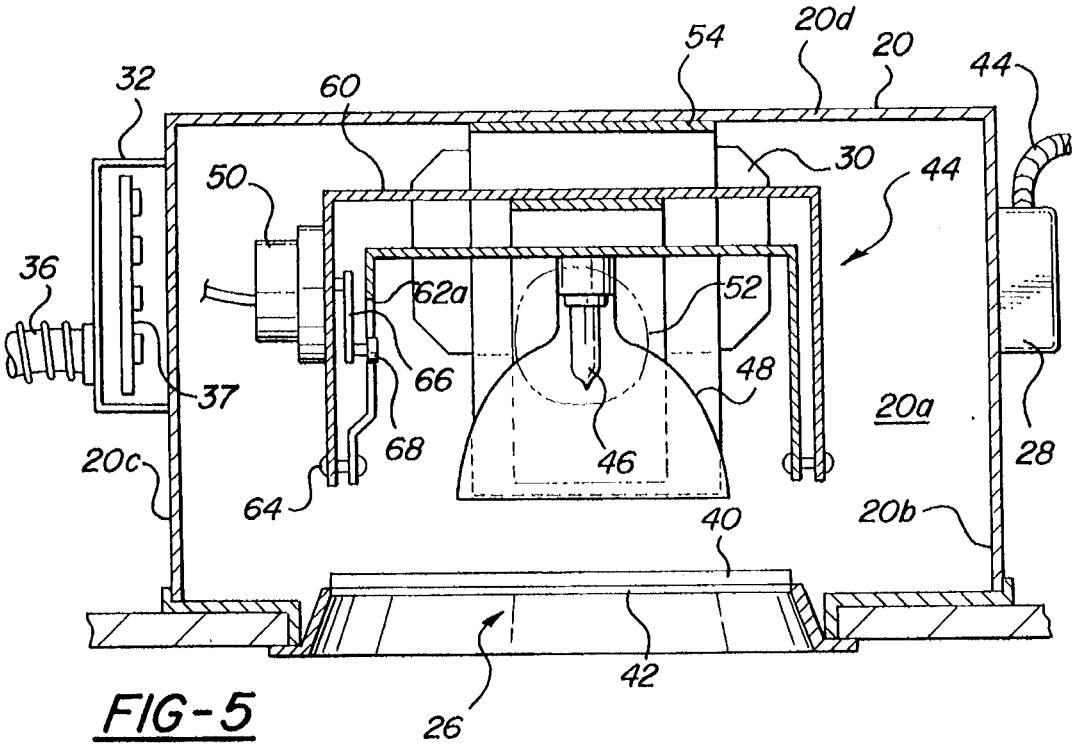
FIGS. 5 and 6 are detail views of a light assembly utilized in the invention lighting system.
Figure 6:
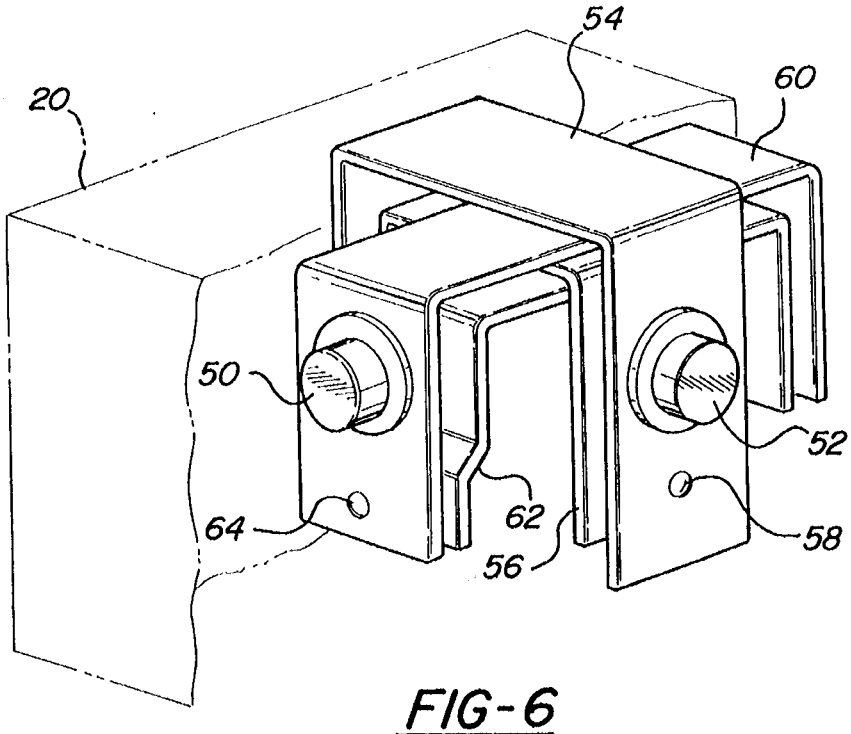
Figure 7:
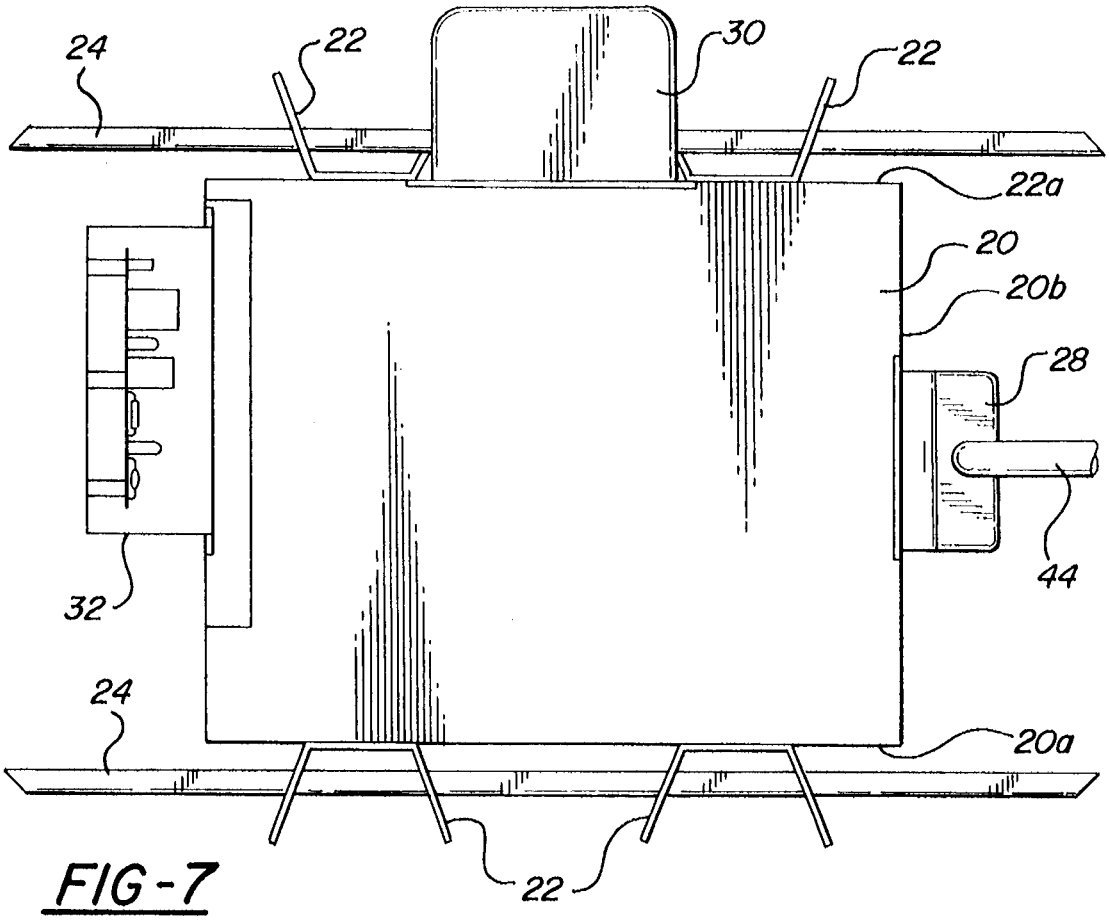
FIG. 7 is a plan view of a light assembly.
Figure 8:
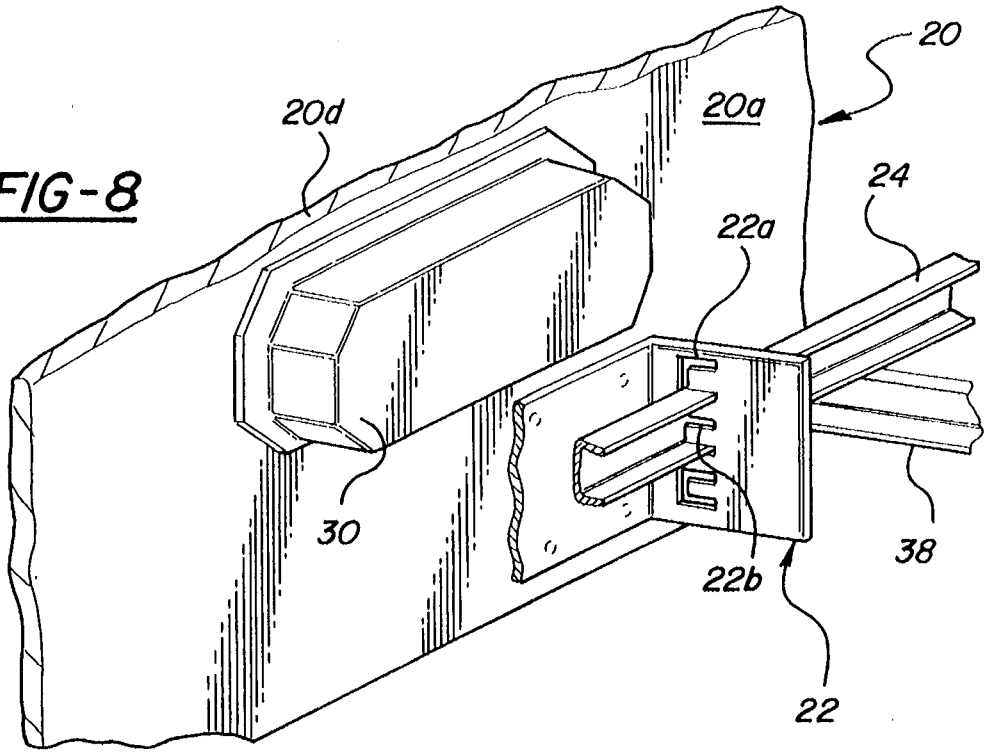
FIG. 8 is a fragmentary perspective view showing the mounting of a light assembly.

Remote control unit 71 comprises an infrared unit functioning in a manner similar to the typical television remote control. Remote control unit 72 is sized to be hand held and includes, on the front face thereof, a control cluster 104 including control elements or switches corresponding to the control elements or switches of the face plate 72 of the wall control unit. Specifically, as seen in FIG. 11, cluster 104 includes a plurality of tactile membrane switches including an on/off switch 104, a select light switch 106, a bright switch 108, a dim switch 110, a foot switch 112, a head switch 114, and adjust position switches 116 and 118. The rear of the remote control unit, as seen in FIG. 12, is generally flat and includes directions for use as well as magnetic elements 119 for coaction with the magnet 102 positioned within the storage area 72*a* of the face plate of the wall control unit.

Remote control unit 72 also includes a beeper 120 of known form and operation which is activated in 60-minute intervals unless the remote is used or returned to the wall plate storage area; a nine-volt battery (not shown); and a low battery LED 121 which is illuminated when the battery voltage falls below 7.5 volts. Remote control unit 72 also includes an infrared transmitter 122 for transmitting infrared signals in response to selective actuation of switches in the switch cluster 104 for receipt by the infrared receiver 78 mounted in the wall control unit.

It will be understood that the membrane switches of the switch cluster 80 of the wall control unit coact in known manner with the circuit board 76 and with the terminal blocks on the rear face of circuit board 76 to transmit electrical signals via the nine leads of the cables 36 to the respective light assembly so as to adjust the angular position of the light assembly and/or adjust the intensity of the lamp of the lamp assembly in accordance with instructions transmitted via the membrane switches of the cluster 80. It will further be understood that the membrane switches of the cluster 104 of the remote control unit coact with the infrared receiver 78, the circuit board 76, and the terminal blocks on the rear face of the circuit board to transmit signals over the nine leads of the cables 36 to the respective light assembly in accordance with selective actuation of the membrane switches of the switch cluster 104 so that the angular position and the intensity of each lamp assembly may be selectively adjusted by selective actuation of the switch elements of the remote control unit switch cluster 104.

Figure 2:
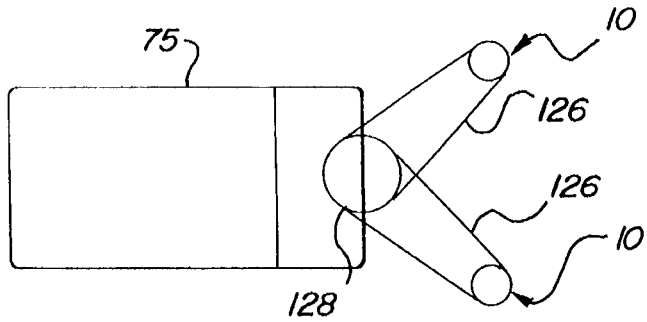
FIG. 2 is an overhead diagrammatic view showing the focussing operation of the invention lighting system.
Figure 3:
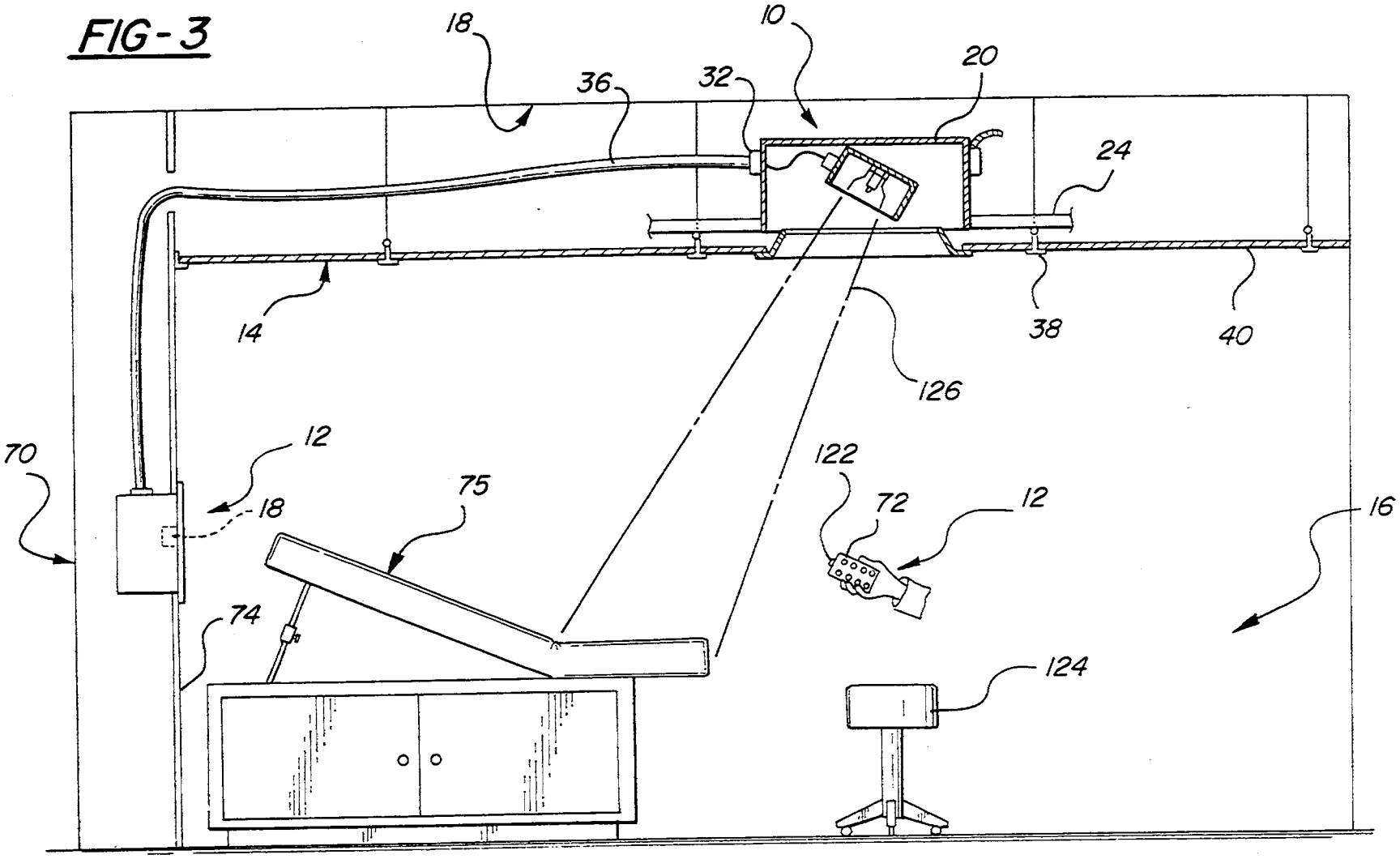
FIG. 3 is a cross-sectional view of the medical procedure room of FIG. 1.

The invention lighting system is seen in FIGS. 1, 2 and 3 installed in a hospital room 16 intended to be utilized for a birthing procedure and including a birthing bed 75 and a stool 124 for use by the professional performing the delivery. In the birthing arrangement seen in FIGS. 1, 2 and 3, the light assemblies are positioned in the drop ceiling 14 of the room in laterally spaced relation and in a position generally overlying the stool 124 so that the individual light beams 126 projected by the light assemblies may be focused on the lower end of the birthing bed to define an area 128 of concentrated shadowless illumination to facilitate the practitioner's role in the birthing procedure.

The selective positioning of the individual beams 126 to form the concentrated light area 128, and the selective variation of the intensity of the light beams 126, is accomplished utilizing either the control elements of the wall control unit 70 and/or the control elements of the remote control unit 71. Specifically, whether the control signals originate with the membrane switches of the remote control unit or the membrane switches of the wall control unit, the signals are transmitted via cables 36 to the respective light assemblies 10 to selectively adjust the angular position of the lamps of the light assemblies and so as to selectively adjust the intensity of the lamps of the light assemblies.

When utilizing the wall control unit 70 to adjust the light assemblies, switch 82 is first utilized to turn the control unit on, whereafter switch 84 is utilized to select either the left light assembly or the right light assembly (as indicated by illumination of the appropriate LED 98 or 100), the intensity of the selected light is thereafter adjusted upwardly by depression of switch 86 or downwardly by depression of switch 88, and the angular position of the lamp of the selected light assembly is adjusted about two axes by selective actuation of switches 90, 92, 94, and 96. Specifically, actuation of switches 90 and 92 selectively energizes motor 52 of the selected light assembly to move the associated lamp assembly about the pivot axis 58 and move the lamp either toward the head of the bed or toward the foot of the bed, depending upon the specific switch element depressed, and selective depression of switches 94 and 96 energizes motor 50 of the selected light assembly to pivot the associated lamp assembly about the pivot axis 64 and move the light beam in opposite lateral directions.

The same control functions may be readily performed utilizing the remote control unit 71. Specifically, unit 71 may be turned on utilizing switch 104, the light assembly to be adjusted may be selected utilizing switch 106 (with the chosen light indicated by illumination of the selected LED 98 or 100 on the wall control unit), the brightness of the selected light may be adjusted up or down utilizing switches 108 and 110, and the longitudinal and angular position of the light beam of the selected light may be adjusted about two axes utilizing switches 112, 114, 116, and 118.

Transformer 30 of each light assembly operates to step down the 120 volt AC line voltage to 24 volts AC for the lamp circuit of each light assembly and, via a central tap, to 12 volts AC for delivery to the control box 32 of the light assembly. The control circuit for each light assembly includes, schematically, a lead 130 extending from a 12 volt tap of the transformer 30 to the control box 32 to provide 12 volts AC to the control box; the control box 32 including circuit board 37 and rectifiers to receive the incoming 12 volt AC signal and convert it to a 12 volt DC signal and a 5 volt DC signal; the associated cable 36 for transmitting 12 volt and 5 volt DC signals to the wall control unit; the associated terminal blocks 76*a* of the circuit board 76 of the wall control unit; a lead 132 extending from the control box to a relay 134 associated with the 24 volt lamp circuit; and leads 136 and 138 extending respectively from the control box 32 to the motors 50 and 52. The entire control circuit for each light assembly is thus maintained at or below 12 volts so that there is no shock danger to medical personnel involved in the medical procedure or to the patient. It will be understood that, of the nine leads included within each control cable 36, three of the leads are power leads (including a ground lead, a 5 volt lead, and a 12 volt lead) and the remaining six leads are control leads to transmit the appropriate control signals to the light assembly. It will further be understood that the separate 5 volt and 12 volt signals provided to the wall control unit via cable 36 are utilized in association with various components of the integrated circuit of the circuit board 76 requiring 5 volt and 12 volt supplies respectively.

The 24 volt AC lamp circuit comprises a lead 140 extending from a 24 volt tap of the transformer 30 to the lamp 46. Relay 134 is associated in known relay manner with lead 140 so that appropriate "bright" and "dim" signals transmitted from the remote control unit 71 or the wall control unit 70 via control box 32 and lead 132 may operate in know manner via relay 134 to vary the energy level of the current flowing through the lead 140 to the lamp 46 and thereby selectively vary the intensity of the light emitted by the lamp 46 in coaction with the reflector 48.

Remote control unit 71, as illustrated, would normally be held by one of the attending medical persons, for example, the medical person performing the actual delivery, and is selectively utilized prior to or during the birthing procedure to selectively adjust the angular position of each light assembly and the intensity of each light assembly so as to provide ideal illumination, both in terms of positioning and intensity, to the birthing area. Alternatively, or cooperatively, another medical person in the birthing room may adjust the angular position and intensity of the lights utilizing the wall control unit.

Figure 13:
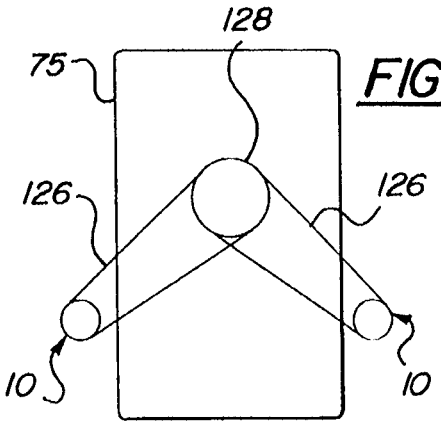
FIGS. 13 and 14 are diagrammatic views corresponding to FIG. 2 but showing alternate installation arrangements for the invention lighting system.
Figure 14:
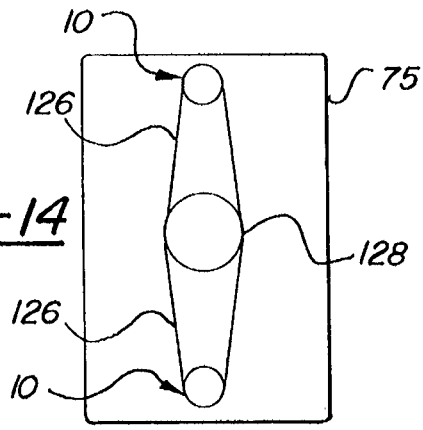

Although the invention lighting system has been illustrated and described thus far with respect to a birthing procedure, it will be apparent that the invention lighting system may be advantageously employed in support of other medical procedures. For example, as seen in FIG. 13, the invention lighting system may be utilized in an emergency room or intensive care unit wherein the light assemblies are arranged relative to the bed 75 to direct the beams 126 of the light assemblies to form a concentrated light focus 128 proximate the head of the bed. As a further example, and as seen in FIG. 14, the invention lighting system may be used to facilitate patient examination in which case the light assemblies 10 may be positioned over opposite ends of the bed 75 with their beams 126 directed to form a concentrated focal area proximate the middle of the bed to facilitate patient examination.

Although the invention has thus far been described with respect to situations in which the beams 126 of the individual light assemblies are brought together to form a common focal area 128, it will be apparent that, by virtue of the individual control provided by the present invention, the individual beams 126 of the individual light assemblies may be individually directed so as to provide proper lighting for two separate medical procedures being carried out at separate locations in the procedure room by separate medical teams. In this situation, one beam may be controlled for example by the remote control unit 71 to provide lighting for one medical procedure and the other beam may be controlled by the wall control unit 70 to provide separately controlled lighting for the other medical procedure.

When not in use, remote control unit 71 is stored in the storage area 72*a* of the wall control unit utilizing the coaction of the magnetic elements 102 and 119. This arrangement ensures that the remote control unit will remain with the rest of the lighting system. In order to further ensure that the remote control unit will not become separated from the remainder of the invention lighting system, the remote control unit, as previously indicated, includes a beeper 120 which is activated in 60 minute intervals unless the remote control unit is utilized during that interval or unless the remote control unit is returned to the wall plate storage area during that interval. Thus, for example, if the remote control unit, following a medical procedure, is inadvertently left in a position separated from the wall control unit, the beeper of the remote control unit will sound after a lapse of 60 minutes to enable the remote control unit to be located and returned to the storage location on the wall control unit.

The invention lighting system will be seen to provide many important advantages. Specifically, the system allows individual direction and intensity control of a pair of light assemblies utilizing a remote control infrared unit; the system allows individual direction and intensity control of a pair of light assemblies utilizing either a wall control unit or a remote control unit; the system provides a low voltage control circuit for each light assembly so as to minimize the possibility of electrical shock to either the patient or the medical personnel; the light assemblies by virtue of their compact size and low weight may be readily installed in the dropped ceiling of a medical procedure hospital room; all of the electronics of the light assemblies are conveniently located in or serviceable from the housing 20 so that all maintenance may be performed simply by removing the lens of the respective light assembly; the assemblies may be readily installed by untrained personnel, and, specifically, the individual color coding of the leads of the control cables 36 and the individual color coding of the terminal blocks on the circuit board of the wall control unit allows the cable 36 of each light assembly to be readily and correctly associated with the proper electrical components of the wall control unit and thereby of the remote control unit; and separation of the remote control unit from the remainder of the lighting system is discouraged by providing a convenient storage area for the remote control unit on the wall control unit and by further providing a warning beeper to guard against inadvertent separation of the remote control unit from the remainder of the system.

Whereas preferred embodiments of the invention have been illustrated and described in detail, it will be apparent that various changes may be made in the disclosed embodiments without departing from the scope or spirit of the invention.

We claim:

1. A room lighting system for medical procedures comprising:

a light assembly including a housing adapted to be mounted in a ceiling of a room and a lamp mounted within the housing for movement between a plurality of angular positions;

a wall control unit adapted to be mounted in a wall of the room and including control elements for controlling the light assembly; and means establishing a first electrical circuit, including said lamp, of a first voltage and a second electrical circuit, including said wall control unit, of a second voltage lower than said first voltage;

said establishing means including a transformer receiving line power and operative to step down said line power to said first voltage for use by said first, lamp circuit and further operative to step down said line power to said second voltage for use by said second, wall control unit circuit.

2. A lighting system according to claim 1 wherein:

the transformer is mounted on the housing of the light assembly.

3. A lighting system according to claim 1 wherein:

said first circuit voltage is approximately 5 volts and said second circuit voltage is approximately 12 volts.

4. A lighting system according to claim 1 wherein:

said wall control unit further includes an infrared receiver; and said lighting system further includes a remote control unit including control elements for controlling the light assembly and operative in response to actuation of said control elements to generate infrared signals for transmission to said infrared receiver.

5. A room lighting system for medical procedures comprising:

a first light assembly adapted to be mounted in the ceiling of the room and including a lamp movable between a plurality of angular positions;

a second light assembly adapted to be mounted in the room ceiling in spaced relation to the first light assembly and including a lamp movable between a plurality of angular positions;

control means comprising a wall control unit hard wired to the light assemblies, adapted to be positioned in a wall of the room, and including control elements operative in response to selective actuation of the elements to selectively and individually adjust the angular position of each lamp of each light assembly; and a remote control unit having control elements corresponding to the control elements of the wall control unit and including an infrared transmitter;

the wall control unit including an infrared receiver operative to receive the transmissions of the infrared transmitter;

the wall control unit defining a storage surface sized to store the remote control unit; and the remote control unit including means operative to emit a warning signal if the remote control unit is separated from the wall control unit for a predetermined length of time or is not activated for a predetermined length of time.

* * * * *

UNITED STATES PATENT AND TRADEMARK OFFICE

CERTIFICATE OF CORRECTION

PATENT NO. : 5,526,245
DATED : June 11, 1996
INVENTOR(S) : Donald Davis

It is certified that error appears in the above-indentified patent and that said Letters Patent is hereby corrected as shown below:

Column 5, Line 21, delete "72" insert --71--.

Column 5, Line 35, delete "72" insert --71--.

Column 5, Line 41, delete "72" insert --71--.

Column 9, Line 7, delete "5 volts" and insert --24 volts--.

Signed and Sealed this

Twenty-first Day of January, 1997

*Attest:*

Bruce Lehman

BRUCE LEHMAN

*Attesting Officer*

*Commissioner of Patents and Trademarks*